United States Patent [19]

Pucher et al.

[11] 3,967,917

[45] July 6, 1976

[54] PROCESS AND EQUIPMENT FOR LIFTING SECONDARY LIQUIDS WITH THE ENERGY OF PRIMARY LIQUIDS

[75] Inventors: Janos Pucher; Antal Schmieder, both of Budapest, Hungary

[73] Assignee: Nikex Nehezipari Kulkereskedelmi Vallalat, Budapest, Hungary

[22] Filed: Feb. 6, 1975

[21] Appl. No.: 547,700

Related U.S. Application Data

[63] Continuation of Ser. No. 423,583, Dec. 10, 1973, abandoned.

[30] Foreign Application Priority Data

June 19, 1970 Hungary ..... PU 171

[52] U.S. Cl. ..... 417/54; 417/103; 417/328; 417/395

[51] Int. Cl.[2] ..... F04B 1/06; F04B 43/06

[58] Field of Search ..... 417/54, 55, 103, 225, 417/226, 227, 328, 383, 389, 394, 395, 349; 141/230; 137/123–130; 222/204, 416

[56] References Cited

UNITED STATES PATENTS

| | | | |
|---|---|---|---|
| 326,266 | 9/1885 | Bryan | 417/395 |
| 2,681,012 | 6/1954 | Hackman | 417/328 |

FOREIGN PATENTS OR APPLICATIONS

| | | | |
|---|---|---|---|
| 1,102,008 | 10/1955 | France | 417/383 |

*Primary Examiner*—C. J. Husar
*Assistant Examiner*—Leonard Smith
*Attorney, Agent, or Firm*—Young & Thompson

[57] ABSTRACT

One liquid is pumped to a higher elevation by another liquid. In a first stage, the pumping liquid is withdrawn from a chamber and the liquid to be pumped is thereby raised and drawn into the chamber by a siphon effect. In a second stage, the pumped liquid is forced out of the chamber and to a higher elevation by re-entry of the pumping liquid into the chamber.

8 Claims, 17 Drawing Figures

INVENTOR

BY

ATTORNEY

INVENTOR

BY

ATTORNEY

INVENTOR

BY

ATTORNEY

INVENTOR

BY

ATTORNEY

INVENTOR

BY

ATTORNEY

Figure 1:
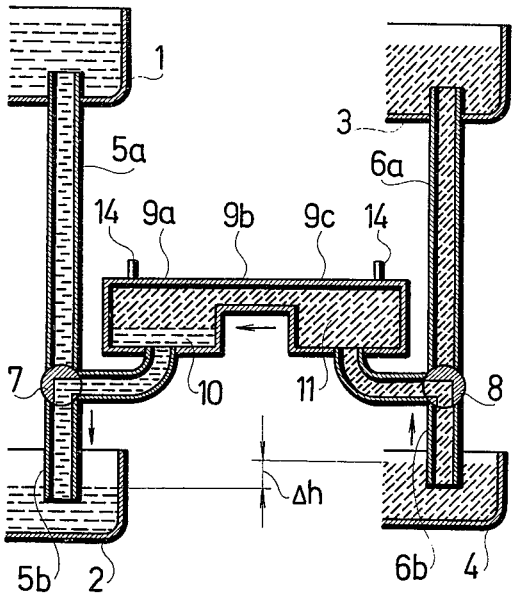

PROCESS AND EQUIPMENT FOR LIFTING SECONDARY LIQUIDS WITH THE ENERGY OF PRIMARY LIQUIDS

This is a continuation of application Ser. No. 423,583, filed Dec. 10, 1973 now abandoned.

The invention relates to a process for lifting secondary liquids with the energy of primary liquids.

It is a generally known fact that along with significant water demands, considerable amounts of waste water are produced in certain industrial plants and while fresh water has to be pumped, in certain cases, from deep wells or other deep supplies, waste water is discharged similarly at a certain depth in many cases without exploiting its potential energy. It also happens that the value of the vertical input and output of water even in an industrial plant is important and may require significant power.

Efforts aiming at the utilization of the energy of waste water for lifting fresh water are obvious. However, processes hitherto applied for this purpose are characterized by fairly low efficiency. With the most general solution, the energy of waste water is converted in a turbine-driven generator into electrical power and this electrical power is then used for driving the pump lifting fresh water to the desired level. The overall efficiency of such apparatus, even in the optimum case, is not higher than 40 to 50 per cent.

With another solution, the turbine driven by waste water is directly coupled to the pump lifting fresh water; however, the efficiency of this apparatus does not exceed 40 to 60 per cent.

Theoretically, the problem might be solved by means of so-called fluid transformers utilizing the kinetic or potential energy of the waste water, as of a primary fluid. The efficiency of known fluid transformers — as e.g. ejector jet pumps, hydraulic rams, steam ejector pumps — exploiting kinetic energy for lifting fresh water as a secondary fluid is, however, hardly 10 to 15 per cent and their application is therefore not economical. The efficiency of mine pumps working with air compressors which may be mostly reckoned with for the exploitation of potential energy is similarly low, due to the considerable volume loss taking place as a result of compressing the air; moreover, the applicability of such machines is also limited to a very small area and consequently cannot meet requirements.

This invention solves the problem of lifting the secondary liquid by means of the potential energy of the primary liquid similary to the principle of the fluid transformer but with a considerably better efficiency than did any earlier known solution, i.e. 85 to 90 per cent or even more in certain cases, with the final result that not more than 10 to 15 per cent of the energy otherwise required for lifting fresh water has to be provided by other means.

Lifting the liquid by this invention takes place in two stages, i.e. intermittently; however, by shifting the working cycles of two or more pieces of equipment, continuous operation can be reached.

The essence of the process of the present invention is that the secondary liquid to be lifted is delivered from the intake basin in one of the stages by siphon action into a system of vessels situated on a higher level and serving as a lock, and then in the next stage, the liquid is raised from this system of vessels into the receiver by the potential energy of the primary liquid.

In the course of this operation, a tertiary liquid may be used as a means of pressure transmission in the system of vessels serving as a lock, between the primary and secondary liquids and instead of or in addition to this tertiary liquid, a limiting member (separating wall) capable of displacement either fully or in part may be applied to separate the primary and/or the secondary liquid. If the differential liquid level necessary to produce siphon action between the intake basin of the secondary liquid and the receiver of the primary liquid is not available, provided that a fully or partly flexible limiting member is utilized, the energy produced due to elastic deformation in the previous stage and stored in this member and/or the differential specific weights of the liquids, preferably of the tertiary liquid or in certain cases, even pumping may be used to produce the corresponding pressure or excess pressure.

In addition to the inherent elasticity of separating walls made of elastic material or of such incorporating springs, separate spring forces related to the separating wall and in the case of heavy or weight-loaded separating walls, the potential energy of such walls with respect to gravity may also be used according to the case for producing the pressure or the excess pressure.

The equipment of the invention is provided with a downpipe between the upper intake basin and the lower receiver of the primary liquid, further with a riser pipe between the lower intake basin and the upper receiver of the secondary liquid, with a connecting system of vessels serving as a lock and having a capacity exceeding the quantity of liquid delivered in one stage, arranged between the riser-pipe and the downpipe, as well as with shutoff devices opening, resp. closing alternately and simultaneously upwards and downwards the downpipe and the riser-pipe with respect to the connecting system of vessels.

In a preferred embodiment of the invention, a tertiary liquid used as a medium or pressure transmission and capable of displacement between the primary and secondary liquids is provided in the system of vessels serving as a lock. In one of the embodiments of the invention, the system of vessels used as a lock incorporates one or several separating walls capable of partial or full displacement whereas in another embodiment, the separating wall is made, partly or in full, of elastic material. Other embodiment of the equipment are also possible wherein the connecting system of the vessels serving as a lock is designed fully or partly in sloping or ascending arrangement and finally, the equipment may also include a pump connected to the connecting system of vessels capable of exerting pressure or suction on liquids in the connecting system of vessels.

In another embodiment of the invention, the separating wall is heavy or weight-loaded.

In order to make the process continuous, two or more pieces of equipment operating in cycles shifted with respect to each other may be connected in parallel and the arbitrarily designed riser or downpipe of the parallel-connected equipment may be fully or in part combined.

In the case of several parallel-connected pieces of equipment it is highly advantageous if connecting members, e.g. pipes are provided between the chambers beside the riser and the downpipe of the system of vessels serving as a lock and these pipes are fitted with shut-off devices opening and closing alternately, corresponding to the shifted cycles at points prior to their connections to the chambers.

The invention is explained in more detail in connection with embodiments of the process referred to by way of example and illustrated in the drawings.

Figure 16:
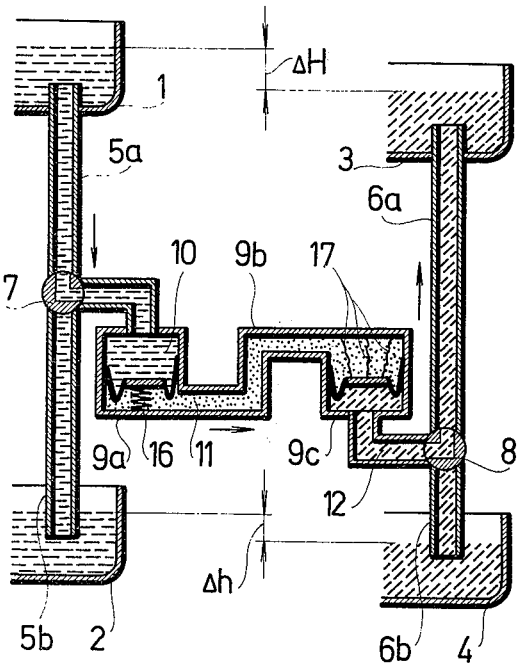
Figure 17:
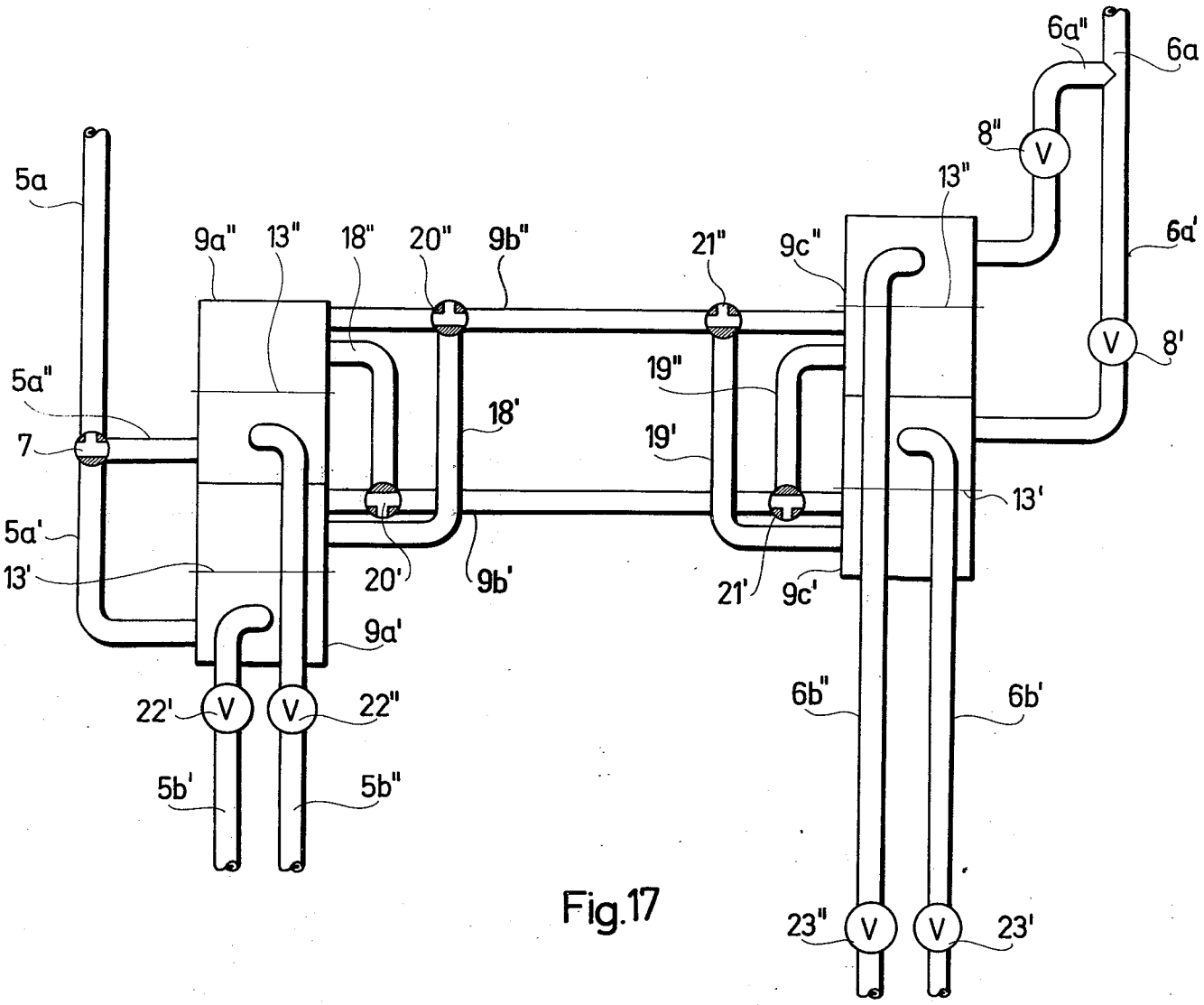

The FIGS. display functional schemes: in the eight different embodiments of the apparatus shown in FIGS. 1 through 16, figures denoted by odd number (on the left-hand side) always refer to the suction stage or stroke (siphon effect), and figures denoted by even numbers (on the right-hand side) serve to demonstrate the function of the pressure stage or stroke, whereas in FIG. 17, the functional scheme of two integrated pieces of equipment operating in cycles shifted with respect to each other and mentioned by way of example is displayed.

Figure 2:
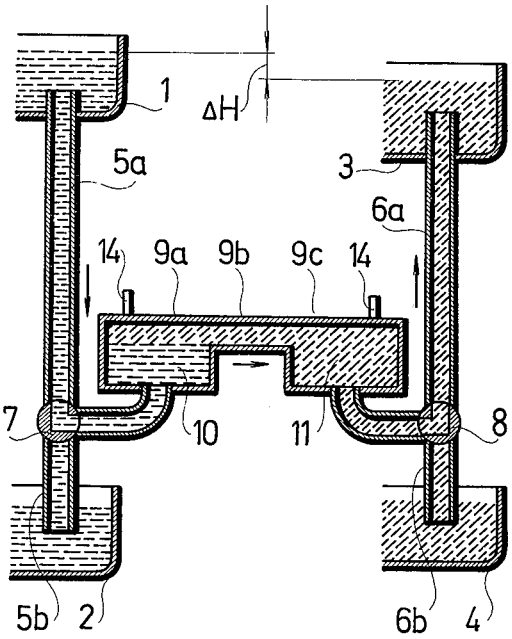

In FIGS. 1 and 2, the upper receiver 1 of the primary liquid (waste water) and the lower receiver 2 are connected by the downpipe comprising the sections 5*a* and 5*b* whereas the lower intake receiver 4 of the secondary liquid fresh water and its upper receiver 3 are interconnected by the riser composed of sections 6*a* and 6*b*.

Between the downpipes 5*a*, 5*b* and the ascending duct 6*a*, 6*b* there is arranged the connecting system of vessels serving as a lock and comprising the chambers 9*a*, 9*c* fitted with the vent 14 and the pipe 9*b* which are connected alternately by the change-over cocks 7 installed in the downcomer and 8 in the ascending duct to the pipe sections 5*a*, 5*b*, resp. 6*a*, 6*b*. The changeover cocks 7 and 8 work jointly, i.e. both cocks open and close simultaneously both upwards and downwards.

The equipment operates as follows: before putting into operation, the system is primed with liquid by filling it at the end towards the downpipe with the primary liquid 10 approx. to the middle of the connecting pipe 9*b* and at the end toward the riser pipe, by filling it completely with the secondary liquid 11. Then the air vents 14 are closed, the change-over cocks 7 and 8 are closed upwards and open downwards and the position shown in FIG. 1 is produced. Since the liquid level in the intake 4 of the secondary liquid stands higher by the value of $\Delta h$ than does the primary liquid in the receiver 2, liquid flows from the siphon comprising the vessels 6*b*, 9*c*, 9*b*, 9*a*, 5*b* in the direction of the arrows and the secondary liquid 11 displaces the primary liquid 10 from the pipe 9*b* and from the chamber 9*a* as well. Then the position of the change-over cocks is changed, i.e. the change-over cocks 7, 8 are opened upwards and closed downwards to produce the position shown in FIG. 2. Then, as a result of the pressure due to the difference in levels $\Delta h$ prevailing in the intake receptacle 1 of the primary liquid and in the receiver 3 of the secondary liquid, liquid flows in the system of communicating vessels comprising vessels 5*a*, 9*a*, 9*b*, 9*c*, 6*a* in the direction of the arrows and the primary liquid 10 displaces the secondary fresh liquid 11 from the chamber 9*a* and the connecting pipe 9*b* and presses it into the receiver 3. However, before the primary return liquid 10 reaches the chamber 9*c*, the change-over cocks 7 and 8 are again closed upwards and opened downwards in order to avoid mixing of the return liquid with the fresh liquid and as a result, liquid flow in the opposite sense, as shown in FIG. 1, starts again in the connecting system of vessels 9*c*, 9*b*, 9*a*.

Since the quantity of the secondary liquid is usually not limited— particularly in the case of rivers — by suitable hydraulic design it may be achieved that the secondary fresh water 11 fully flushes the connecting system of vessels 9*c*, 9*b*, 9*a* in the first stage.

Figure 3:
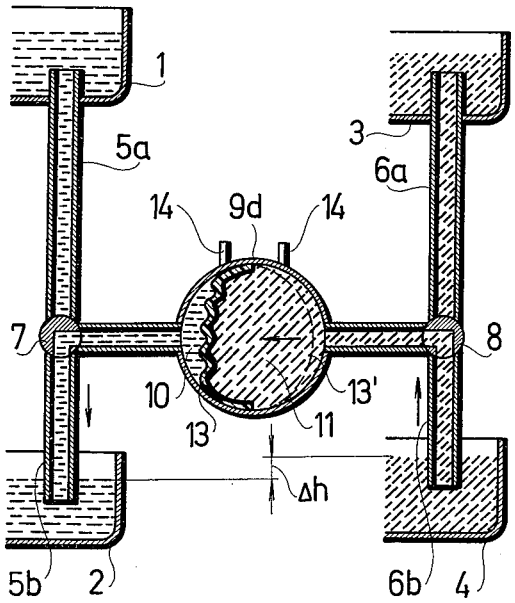
Figure 4:
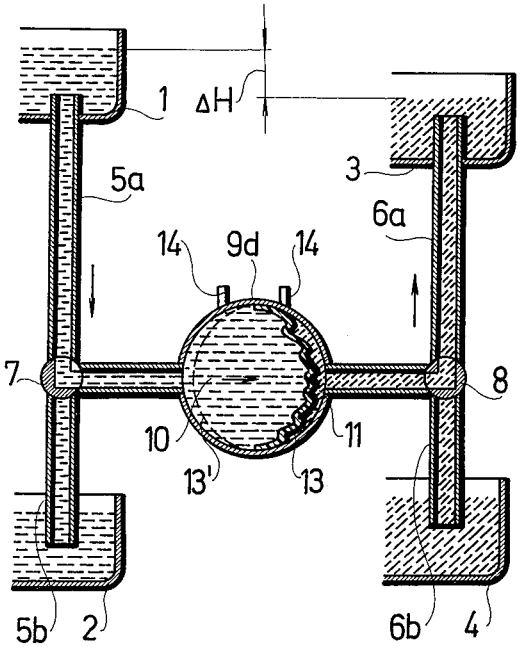

In FIGS. 3 and 4 an apparatus is shown wherein the mixing of the primary liquid 10 and separating liquid 11 is ensured by a separate built-in flexible separting wall e.g. plastic foil, secured around its periphery and capable of displacement in between. In this apparatus the connecting system of vessels comprises essentially the chamber 9*d* connected by the change-over cocks 7 and 8 with the downpipes 5*a*, 5*b* resp. with the ascending ducts 6*a*, 6*b*. The capacity of chamber 9*d* corresponds to the quantity of secondary water to be pumped in one stage. The other parts of the equipment are similar to those of the equipment depicted in FIGS. 1 and 2. Due to the siphon effect, in FIG. 3, the secondary liquid 11 displaces the primary liquid 10 from the chamber 9*d* while the separating wall 13 is displaced, by pressure, from its position denoted by the dashed line 13' and is pressed against the wall of chamber 9*d*, into the position marked by the continuous line 13. When the chamber 9*d* is thus filled with secondary water 11, the change-over cocks 7 and 8 are reset to the upwards open position, corresponding to FIG. 4. Now, the primary liquid 10 will displace the secondary liquid 11 from the chamber 9*d* and forces it into the receiver 3 while the flexible separating wall 13 is displaced from its position 13' denoted by the dashed line into its other position 13 depicted by the continuous line.

Figure 5:
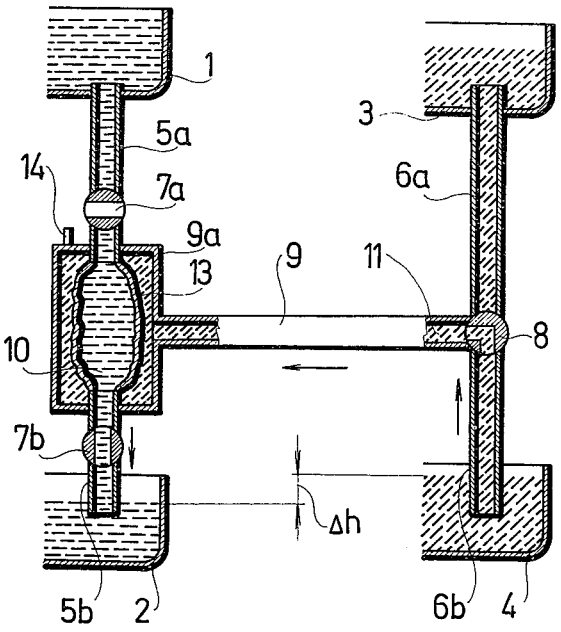
Figure 6:
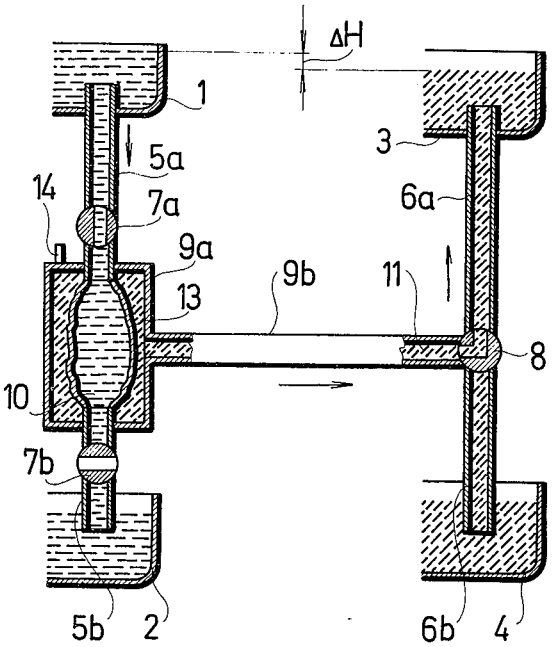

An example of a similar equipment is also shown in FIGS. 5 and 6. Here, the chamber 9*a* is installed in the line of the downpipes 5*a*, 5*b* and is separated from the sectin of 5*a* by the cock 7*a* and from the section of 5*b* by the cock 7*b*. The connecting system of vessels serving as a lock comprises the chamber 9*a* and the pipe 9*b*. In this case, the flexible separating wall 13 capable of displacement in part, is a sleeve open toward the cocks 7*a* and 7*b* which compresses in the suction stage operated by siphon action and is pressed against the wall of chamber 9*a* in the compression stage.

Instead of the flexible separating walls 13 displayed in FIGS. 3 and 4 as well as in FIGS. 5 and 6, a number of separating walls capable of displacement and of similar effect may otherwise be used in suitably designed vessels, thus e.g. walls moving like bellows or even plungers with rigid separation faces, etc.

Evidently, these equipments are only operative if the liquid level in the intake receiver of the secondary liquid is higher than the level in the receiver of the primary liquid. Since, however, industrial plants are usually laid out along rivers and the intake of their secondary liquid — fresh water — as well as the receiver of their primary liquid — waste water — is usually the same river bed, the difference in the height of the water level cannot usually be used for practical purposes. For this reason, the present invention provides a separate process and equipment in order to substitute the pressure otherwise provided by this difference in levels.

Figure 7:
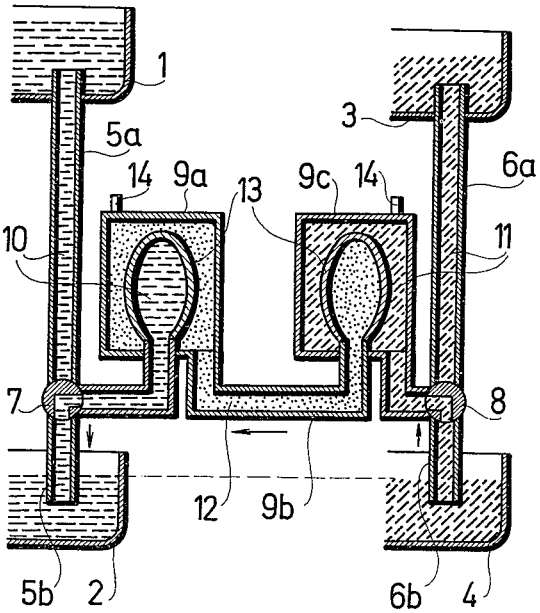
Figure 8:
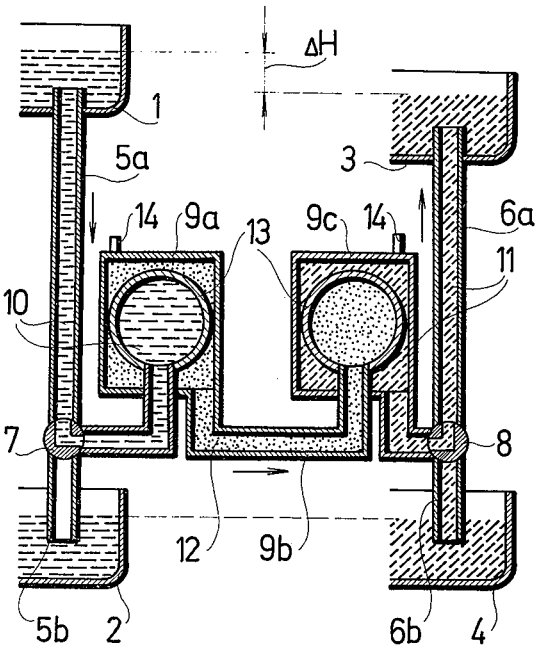

Both in the connecting system of vessels comprising the chambers 9*a*, 9*c* and the pipe 9*b* shown in FIGS. 7 and 8 and in the chambers 9*a* and 9*c*, an elastic bag 13 with the mouth open toward the downpipe is incorporated as a flexible separating wall and the space between the two elastic bags 13 is filled with the tertiary liquid 12. In the position shown in FIG. 7, the secondary liquid 11 has to displace the tertiary liquid 12 from the chamber 9*c* and the tertiary liquid, in turn, has to displace the primary liquid 10 from the chamber 9*a*. Since in the system of vessels 6*b*, 9*c*, 9*b*, 9*a*, 5*b* the liquid is at equilibrium due to the equal liquid level in the receiver 2 and the intake basin 4 no flow is initiated without separate action. However, since in the previous stage or stroke shown in FIG. 8, the required difference in levels $\Delta h$ has been used not only for forcing the secondary liquid 11 into the receiver 3 but also for extending the elastic bags 13, now, in the position shown in FIG. 7, the tensile force stored in the elastic bags 13 displaces the secondary liquid from the chamber 9*a* and the tertiary liquid from the chamber 9*c*. It is mentioned that our experimental results confirmed that a comparatively very small tensile force is sufficient to perform this actuation of the liquid.

Figure 9:
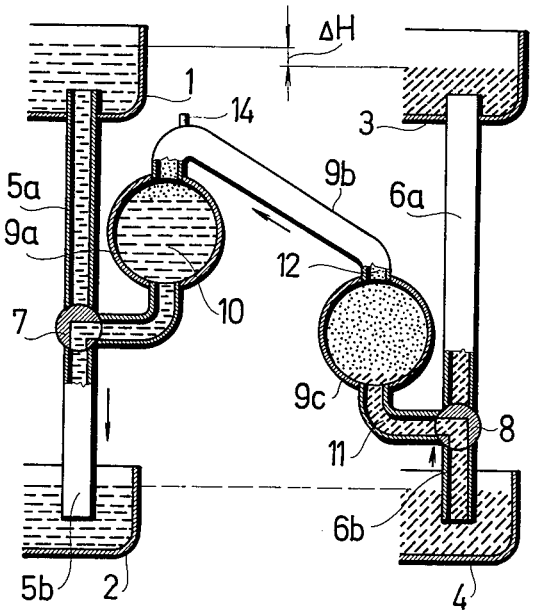
Figure 10:
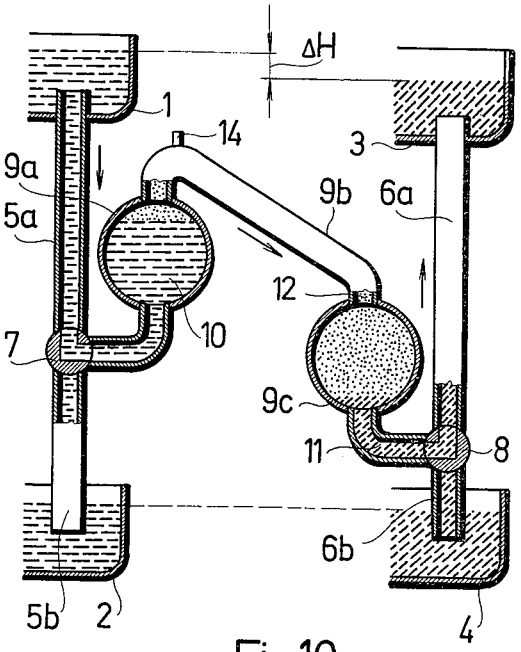

If the liquid levels in the intake of the secondary liquid and in the receiver of the primary liquid are equal or almost equal and moreover, in certain cases even if the liquid level in the receiver of the primary liquids is higher but the specific weight of the fresh secondary liquid and/or of the employed tertiary liquid is smaller than that of the waste primary liquid, the equipment shown in FIGS. 9 and 10 may be used. In the example shown in those figures, a tertiary liquid having a specific weight smaller than the primary liquid is used.

The connecting system of vessels comprising the chambers 9*a*, 9*c* and the pipe 9*b* is arranged in this case with a gradient from the downpipe, resp. toward the ascending duct. As a result, in the position shown in FIG. 9 and in the stage shown in FIG. 10, the tertiary liquid 12 in the chamber 9*c* tends, due to its lower specific weight, to rise and displace the primary liquid 10 from the chamber 9*a*. As shown in FIG. 8, subsequently the primary liquid 10 having a liquid column larger by $\Delta h$ forces down again the tertiary liquid 12 in the direction of the smaller liquid column, into the chamber 9*c*.

Figure 11:
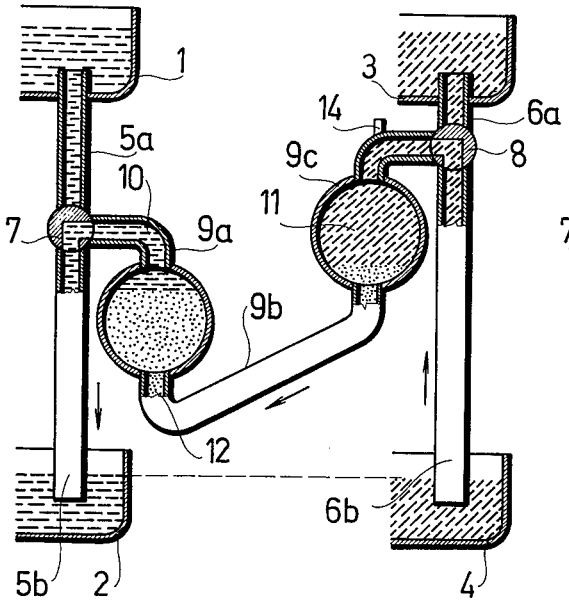
Figure 12:
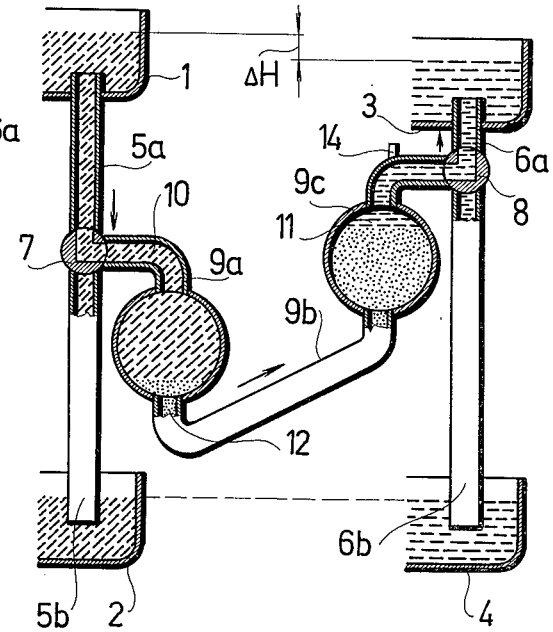

The opposite-hand view of this equipment is shown by FIGS. 11 and 12 operating in the opposite sense but in a similar way, with the difference that in this case it is the specific weight of the industrial waste water — the primary liquid which is lower than that of the secondary fresh liquid or the specific weight of the tertiary liquid is higher than that of the primary liquid. Now, showing the application of the tertiary liquid once again, in the suction stage shown in FIG. 11, the primary liquid 10 is forced downwards out from the chamber 9*a* from the position of the previous compression stage depicted in FIG. 12, due to the higher specific weight of the tertiary liquid 13 and subsequently, as shown in FIG. 12, due to the liquid column larger by $\Delta h$ of the primary liquid 10, the tertiary liquid 12 is again pressed upwards from here and the secondary liquid 11 is delivered further on toward the receiver 3.

Figure 13:
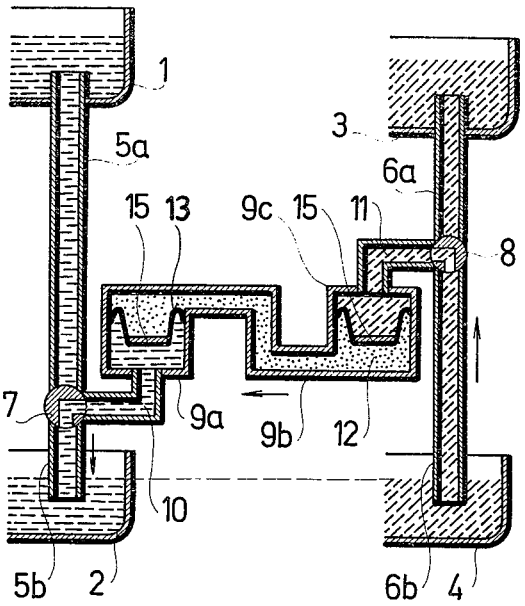
Figure 14:
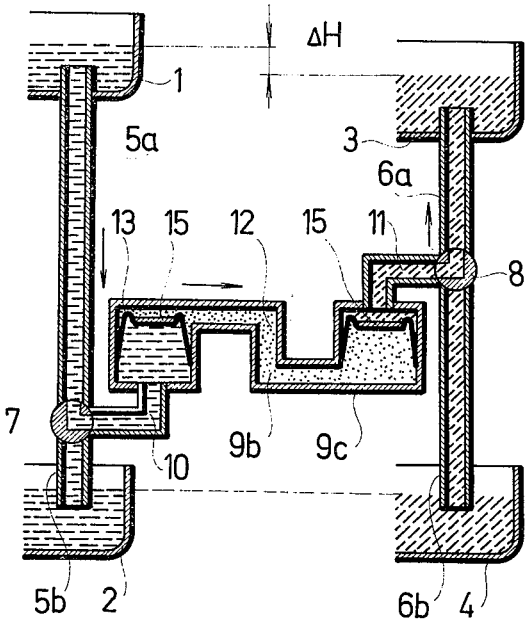

In FIGS. 13 and 14, is shown an apparatus wherein the separating wall 13 arranged horizontally in both chambers 9*a* and 9*c* is loaded with a weight 15. In the suction stage depicted in FIG. 13, the weights 15 act to depress the tertiary liquid 12 and the primary liquid 10 and so the secondary liquid 11 flows into the chamber 9*c* via the ascending duct 6*b* and the change-over cock 8. In the discharge or pressure stage shown in FIG. 14, the change-over cocks 7 and 8 change over and flow of the primary liquid 10 from the intake starts toward the chamber 9*a* via the downpipe 5*a* and the change-over cock 7 and since the level difference $\Delta h$ is suitably designed, it forces, by means of the tertiary liquid 12, not only the secondary liquid 11 from the chamber 9*c* through the cock 8 and via the ascending duct 6*a* into the receiver 3 but it also raises the weight 15 on the separating wall 13 within the chambers 9*a* and 9*c* which, in turn, is thus made capable of again carrying out the work necessary in the suction stage. The performance — the output — may be increased or decreased by selecting, as necessary, the weight and the value of $\Delta h$ and correspondingly, the motion of the weight 15 takes place at a higher or lower rate, resp. the cycle of a stage becomes shorter or longer.

Figure 15:
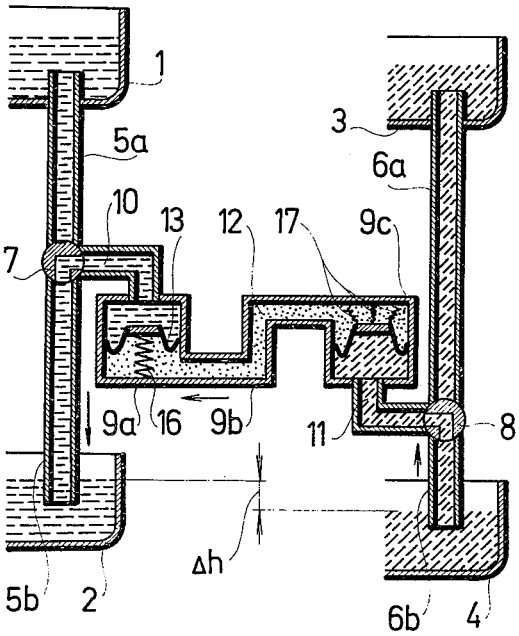

In FIGS. 15 and 16, the level in the receiver 2 of the primary liquid is higher than the liquid level in the intake basin 4 of the secondary liquid. The weight connected with the separating wall 13 is replaced in this case by the compression spring 16 in the chamber 9*a* and by the tension springs 17 in chamber 9*c*. Otherwise, the equipment operates similarly to that shown in FIGS. 14 and 15. Since the primary liquid 10 had to be delivered to a higher level by siphon effect, evidently stronger springs 16 and 17 had to be applied and a larger difference in liquid levels $\Delta H$ had to be used to produce the energy stored in the springs.

The pieces of equipment here shown may also be operated in combination. Thus, e.g. the equipment shown in FIGS. 9 and 10, resp. 11 and 12 may be integrated by means of several intermediate chambers and by using several tertiary liquids of lower and heavier specific weights, applied alternatively; moreover, of the equipment shown in FIGS. 7 and 8, 13 and 14, resp. 15 and 16 e.g. one piece of equipment may be combined with one or several other pieces of equipment and a pump may also be connected with the connecting system if vessels and pumping may be employed alone or jointly with the effects shown in the figures for producing the pressure that corresponds to the otherwise necessary liquid level, in addition to the siphon effect.

Liquid delivery may be made continuous by using several pieces of equipment with shifted operating cycle. By combining the risers and/or downpipes of the equipment, the flow of the liquid masses moving in them is made continuous and the loss originating from accelerating the liquid in rest position to the operating velocity may thus be eliminated. Further losses may be eliminated by combining the pipes connecting the chambers situated in the sense of the downpipes and riser branches of the equipment by using a certain system. In FIG. 17 is shown the functional scheme of an embodiment, presented by way of example, of continuously operating equipment, incorporating a combination of the two pieces of equipment shown in FIGS. 13 and 14.

In FIG. 17, the upper system incorporating the downpipes 5*a*, 5*a*'', the chamber 9*c*'', the risers 6*a*'' and 6*a* comprises the compression (discharge) stage, the lower system incorporating the riser 6*b*', the chamber 9*c*', the connecting pipe 9*b*', the chamber 9*a*', the downcomer the chamber 9*a*',the downcomer 5*a*' comprising the suction stage. To the upper system there also belong the downpipe 5*b*'', the downpipe 6*b*'', the duct branches 18'' and 19'' which, in the actual position, i.e. in the actual stage are kept closed by the pneumatic valve 22'', the change-over cocks 20'' and 21', as well as by the self-acting footvalve 23''. Similarly to the lower system there also belong the downpipe 5*a*', the riser 6*a*', the duct branches 18' and 19' which are similarly kept closed in this stage by the change-over cock 7, the change-over cocks 20' and 21' and the self-acting check valve 8'. At the same time, the change-over cock 7 is open at the downpipe 5*a*, toward the downpipe 5*a*'' and the chamber 9*a* whereas the change-over cock 20'' is open at the chamber 9a and at the connecting duct 9b'', the change-over cock 21'' is open at the chamber 9c'', the self-acting check valve 8'' at the chamber 9c'' and toward the riser 6a'', further, the pneumatic valve 22' at the chamber 9a' and toward the downpipe 5b', the change-over cock 20' is open at the connecting duct 9b' toward the chamber 9a' the change-over cock 21' being open at the chamber 9c' toward the connecting duct 9b' and finally, the self-acting foot valve 23' toward the riser 6b' and the chamber 9c'.

Corresponding to the arrows plotted in the figures, in this position, the primary liquid flowing in the downpipe 5a fills the chamber 9a'' wherefrom it displaces the tertiary liquid which, in turn, flows via the connecting pipe 9b'' into the chamber 9c'' and displaces the secondary liquid from this chamber which then flows in the riser 6a upwards. At the same time, the secondary fresh liquid flows from the bottom through the riser 6b' into the chamber 9c' wherefrom it displaces the tertiary liquid which then flows in the connecting duct 9b' into the chamber 9a' wherefrom the primary liquid leaves through the downpipe 5b'.

When stages are changed over, i.e. if all valves and change-over cocks change into the other position, the tertiary liquid flows from the chamber 9a' via the duct branch 18' again in the duct 9b'' and is led through the duct branch 19'' into the chamber 9c' while from the chamber 9c'', the tertiary liquid flows again through the duct branch 19' in the duct 9b' and the branch duct 18'' into the chamber 9a''. Thus, in this stage, the liquid always flows opposite to the direction indicated by the arrow, except in connecting ducts 9b' and 9b'' where the direction of flow is always the same and corresponds to the direction of the arrows plotted in the figure. Consequently, in this case it is not even necessary to accelerate the tertiary liquid and this again results in some increase of the efficiency.

By using a more intricate system of pipeline and shutoff device, the connecting pipes of several parallel-connected pieces of equipment may also be integrated and at the same time, the risers and downpipes and moreover, possibly e.g. several chambers at the riser end, etc. may be integrated, corresponding to the given requirements and expediency.

It follows from the basic hydraulic conditions of the present invention that in the case of primary and secondary liquids of equal specific weight, the application of the equipment has one limit only: the connecting system of vessels may not be arranged at a height above the liquid level in the intake of the secondary liquid wuich exceeds the head of the siphon; this head, in the case of water, is, for practical purposes, approx. 8 m. Even with rivers of considerably varying discharge, this height is sufficient to enable the construction and maintenance of the connecting system of vessels over land. The differential liquid level necessary to provide for the flow necessary in the system of communicating vessels and during the compression (discharge) stage may, on the other hand, be reduced to a very small value, by increasing pipe diameters and by thus reducing resistances; the head itself is not limited at all. It is therefore possible and often worth while to operate a pump to complete the siphon effects in the suction stage since the head necessary for this purpose is insignificant compared to the head to which the secondary fresh water may be lifted by the equipment of this invention.

The shutoff device may be actuated automatically, e.g. by the time demand of stages or by control based on detecting flowing liquids or the motion of the separating wall etc. The cocks of the shutoff device incorporated in both the riser and the downpipe may be actuated mechanically pneumatically or hydraulically but a pair of self-acting, valves e.g. ball valves, etc. may also be incorporated in the riser.

Finally, it is mentioned that the operation of the equipment is evidently not influenced by various floating matter in both the primary and secondary liquids. Under given conditions, the equipment may thus also be used for hydraulic delivery, sewage lifting, etc.

What we claim is:

1. A process for elevating a secondary liquid with the potential energy of a falling primary liquid through energy exchange between the primary and secondary liquids in a plurality of vessels in which the primary and secondary liquids move with reciprocating motion and in which the intermixing of said primary and secondary liquids is prevented, comprising lifting the secondary liquid in two stages comprising a pressure stage and a suction stage, discharging said secondary liquid from said system during said pressure stage, drawing said primary liquid into said system during said pressure stage, drawing said secondary liquid into said system during said suction stage, discharging said primary liquid from said system during said suction stage, increasing the elevation of a portion of said primary liquid to increase the potential energy thereof, then decreasing the elevation of said portion of primary liquid to effect said suction stage of said secondary liquid, and disposing between said primary and secondary liquids a vertically movable weight means that separates said liquids from each other and whose potential energy is increased by said upward movement of a portion of said primary liquid and whose downward movement effects said suction stage of said secondary liquid, said primary and secondary liquids being continuously in contact with said weight means whereby vertical movement of said weight means transfers energy between said liquids.

2. A process as claimed in claim 1, said weight means comprising a solid member of specific gravity greater than the specific gravity of said primary and secondary liquids.

3. A process as claimed in claim 1, said weight means comprising a liquid.

4. A process as claimed in claim 1, said weight means comprising a pair of spaced solid members of specific gravity greater than the specific gravity of said primary and secondary liquids, and a liquid disposed between said solid members.

5. Apparatus for elevating a secondary liquid with the potential energy of a primary liquid through energy exchange between the primary and secondary liquids, comprising a plurality of vessels having inlets and outlets for the primary and secondary liquids and in which the primary and secondary liquids move with reciprocating motion, means preventing the intermixing of said primary and secondary liquids, the lifting of the secondary liquid taking place in two stages comprising a pressure stage and a suction stage, valve means controlling the flow of said primary and secondary liquids for increasing the elevation of a portion of said primary liquid to increase the potential energy thereof and for then decreasing the elevation of said portion of primary liquid to effect said suction stage of said secondary liquid, and vertically movable weight means that is disposed in working chamber means and that separates said liquids from each other and whose potential energy is increased by said upward movement of a portion of said primary liquid and whose downward movement effects said suction stage of said secondary liquid, said vessels for said primary liquid being disposed one above and one below said valve means and communicating through said valve means with said working chamber means on one side of said weight means, said vessels for said secondary liquid being disposed one above and one below said valve means and communicating through said valve means with said working chambers means on the other side of said weight means.

6. Apparatus as claimed in claim 4, said weight means comprising a solid member of specific gravity greater than the specific gravity of said primary and secondary liquids.

7. Apparatus as claimed in claim 4, said weight means comprising a liquid.

8. Apparatus as claimed in claim 5, said weight means comprising a pair of spaced solid members of specific gravity greater than the specific gravity of said primary and secondary liquids, and a liquid disposed between said solid members.

* * * * *